US012082725B2

(12) United States Patent
Schneider et al.

(10) Patent No.: US 12,082,725 B2
(45) Date of Patent: Sep. 10, 2024

(54) BEVERAGE CONTAINER COVER ASSEMBLY

(71) Applicant: Milwaukee Electric Tool Corporation, Brookfield, WI (US)

(72) Inventors: Joshua D. Schneider, Grayslake, IL (US); Evan Maverick James Quiros, Milwaukee, WI (US); George Barton, Mequon, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 114 days.

(21) Appl. No.: 17/747,341

(22) Filed: May 18, 2022

(65) Prior Publication Data

US 2022/0354283 A1 Nov. 10, 2022

Related U.S. Application Data

(63) Continuation of application No. PCT/US2022/028033, filed on May 6, 2022.

(60) Provisional application No. 63/185,701, filed on May 7, 2021.

(51) Int. Cl.
*A47G 19/22* (2006.01)
*B65D 47/26* (2006.01)

(52) U.S. Cl.
CPC ..... *A47G 19/2272* (2013.01); *B65D 47/265* (2013.01)

(58) Field of Classification Search
CPC .... B65D 47/265; B65D 47/261; B65D 47/26; B65D 51/18; B65D 2313/04; B65D 2543/00046; B65D 2543/00009; B65D 2251/0003; A47G 19/2272
USPC ..... 220/254.8, 254.5, 254.3, 254.1, 253, 220/259.4, 259.3, 256.1, 230, 713, 714, 220/711, 827
See application file for complete search history.

(56) References Cited

U.S. PATENT DOCUMENTS

| | | | |
|---|---|---|---|
| 4,171,060 | A | 10/1979 | Howard et al. |
| 4,712,704 | A | 12/1987 | Ramsey et al. |
| 5,294,014 | A | 3/1994 | Wyatt et al. |
| 5,477,980 | A | 12/1995 | Chaffin |
| 5,711,452 | A | 1/1998 | Chaffin |
| 6,352,166 | B1 | 3/2002 | Copeland |

(Continued)

FOREIGN PATENT DOCUMENTS

| | | | |
|---|---|---|---|
| CA | 3168010 A1 * | 12/2018 | ..... A45F 3/16 |
| CN | 203195260 | 9/2013 | |

(Continued)

OTHER PUBLICATIONS

International Search Report and Written Opinion for International Application No. PCT/US2022/028033, dated Aug. 22, 2022, 11 pages.

*Primary Examiner* — Robert J Hicks
(74) *Attorney, Agent, or Firm* — Reinhart Boerner Van Deuren s.c.

(57) ABSTRACT

A beverage container cover assembly is provided that is configured to enclose a beverage within a beverage container. The beverage container cover assembly includes a lid, a lid cover, and one or more magnetically-interfacing elements that bias the lid and lid cover with respect to each other. The beverage container cover assembly includes a biasing interface between a lid and a lid cover to bias the lid cover to remain stationary with respect to the lid.

16 Claims, 13 Drawing Sheets

(56) References Cited

U.S. PATENT DOCUMENTS

| | | | | |
|---|---|---|---|---|
| 8,360,258 | B2 | 1/2013 | Gilbert et al. | |
| 8,464,895 | B2 | 6/2013 | Gilbert et al. | |
| 8,573,431 | B2 | 11/2013 | Shepard et al. | |
| 8,746,496 | B2 | 6/2014 | Gilbert et al. | |
| 9,375,107 | B2 | 6/2016 | Gilbert et al. | |
| 10,023,366 | B2 | 7/2018 | Gilbert et al. | |
| 10,035,629 | B2 | 7/2018 | Gilbert et al. | |
| 10,071,838 | B2 | 9/2018 | Gilbert et al. | |
| 10,077,144 | B2 | 9/2018 | Gilbert et al. | |
| 10,124,942 | B2 | 11/2018 | Seiders et al. | |
| 10,227,166 | B2 | 3/2019 | Gilbert et al. | |
| 10,232,987 | B2 | 3/2019 | Gilbert et al. | |
| 10,232,992 | B2 | 3/2019 | Seiders et al. | |
| 10,232,993 | B2 | 3/2019 | Seiders et al. | |
| 10,329,061 | B2 | 6/2019 | Dias et al. | |
| 10,421,587 | B2 | 9/2019 | Gilbert et al. | |
| 10,870,522 | B2 | 12/2020 | Lane | |
| 2005/0006386 | A1 | 1/2005 | Ronn et al. | |
| 2006/0283859 | A1 | 12/2006 | Lu | |
| 2007/0164027 | A1* | 7/2007 | Auer | B65D 47/0847 220/784 |
| 2010/0032403 | A1* | 2/2010 | Hajichristou | B65D 50/061 215/337 |
| 2013/0233898 | A1* | 9/2013 | Resnikoff | A47G 19/2272 222/568 |
| 2015/0076151 | A1* | 3/2015 | Knipe | A47G 19/2272 220/254.1 |
| 2018/0127165 | A1 | 5/2018 | Smaldone et al. | |
| 2019/0152661 | A1 | 5/2019 | Seiders et al. | |
| 2019/0389632 | A1 | 12/2019 | Isengingo | |
| 2020/0039706 | A1 | 2/2020 | Gilbert et al. | |
| 2020/0231345 | A1 | 7/2020 | Lane et al. | |
| 2020/0331670 | A1 | 10/2020 | Seiders et al. | |
| 2020/0331671 | A1 | 10/2020 | Seiders et al. | |
| 2020/0361672 | A1 | 11/2020 | Jinkins et al. | |
| 2020/0377273 | A1 | 12/2020 | Seiders et al. | |
| 2021/0047089 | A1 | 2/2021 | Seiders et al. | |

FOREIGN PATENT DOCUMENTS

| | | | |
|---|---|---|---|
| CN | 203969968 | 12/2014 | |
| CN | 103054426 | 1/2015 | |
| CN | 204580762 | 8/2015 | |
| CN | 105147013 | 3/2017 | |
| CN | 107874548 | 4/2018 | |
| CN | 108771431 | 11/2018 | |
| CN | 106724563 | 2/2019 | |
| CN | 110279295 | 9/2019 | |
| CN | 210055531 | 2/2020 | |
| CN | 210249410 | 4/2020 | |
| CN | 210446545 | 5/2020 | |
| CN | 210540511 | 5/2020 | |
| CN | 210697021 | 6/2020 | |
| CN | 211093209 | 7/2020 | |
| CN | 111631575 | 9/2020 | |
| CN | 212186046 | 12/2020 | |
| DE | 102016215239 | 2/2017 | |
| KR | 10-1875498 | 7/2018 | |
| WO | WO-2007052014 A1 * | 5/2007 | B65D 43/0212 |

* cited by examiner

BEVERAGE CONTAINER COVER ASSEMBLY

CROSS-REFERENCE TO RELATED PATENT APPLICATIONS

The present application is a continuation of International Application No. PCT/US2022/028033, filed May 6, 2022, which claims the benefit of and priority to U.S. Provisional Application No. 63/185,701, filed on May 7, 2021, each of which is incorporated herein by reference in its entirety.

BACKGROUND OF THE INVENTION

The present disclosure is directed generally to containers and related devices. The present disclosure relates specifically to a lid assembly for a beverage container.

Beverage containers are often used to transport beverages for consumption. Beverage containers often include a cover or a lid that encloses the beverage within the container.

SUMMARY OF THE INVENTION

One embodiment of the invention relates to a drinking container including a bottom panel that comprises a bottom-most surface, a wall that extends upwardly from the bottom panel, a lid coupled to the wall, a first magnetically-responsive element coupled to the lid, a lid cover rotatably coupled to the lid, and a second magnetically-responsive element coupled to the lid cover. The wall and bottom panel collectively define a liquid-storage area, and the wall defines an upper opening opposite the bottom panel. The lid partially covers the upper opening, and the lid defines a drinking opening smaller than the upper opening. The lid cover actuates between an open position and a closed position with respect to the lid. When the lid cover is in the closed position the lid cover occludes the drinking opening, and when the lid cover is in the open position the drinking opening provides fluid communication between the liquid-storage area and an exterior of the drinking container. Magnetic engagement between the first magnetically-responsive element and the second magnetically-responsive element biases the lid cover from transitioning from the closed position to the open position.

Another embodiment of the invention relates to a drinking container including a body defining a liquid-storage area and an upper opening, a lid coupled to the body and partially covering the upper opening, the lid defining a drinking opening smaller than the upper opening, a first magnetically-responsive element coupled to the lid, a lid cover rotatably coupled to the lid, and a second magnetically-responsive element coupled to the lid cover. The lid cover actuates between an open position and a closed position with respect to the lid. When the lid cover is in the closed position the lid cover occludes the drinking opening, and when the lid cover is in the open position the drinking opening provides fluid communication between the liquid-storage area and an exterior of the drinking container. Magnetic engagement between the first magnetically-responsive element and the second magnetically-responsive element biases the lid cover from transitioning from the open position to the closed position.

Another embodiment of the invention relates to a drinking container including a bottom panel that comprises a bottom-most surface, an axis around which the bottom panel is centered, a wall that extends upwardly from the bottom panel, the wall and bottom panel collectively defining a liquid-storage area, the wall defining an upper opening opposite the bottom panel, a lid coupled to the wall, the lid partially covering the upper opening and the lid defining a first drinking opening smaller than the upper opening, a projection extending inwardly from the lid towards the axis, and a lid cover rotatably coupled to the lid. The lid cover actuates between an open position and a closed position with respect to the lid. The lid cover defines a second drinking opening aligned with the first drinking opening when the lid cover is in the open position. The lid cover defines an upper surface facing upward away from the bottom panel, a lateral surface facing radially away from the axis, and an angled upper edge extending between the lateral surface and the upper surface. The angled upper edge extends circumferentially away from the second drinking opening. Frictional engagement between the projection and the angled upper edge biases the lid cover to remain stationary with respect to the lid.

Another embodiment of the invention relates to a beverage container including a bottom panel that includes a bottom-most surface. The beverage container includes a wall that extends upwardly from the bottom panel. The wall defines an opening opposite the bottom panel. The beverage container includes a lid, a first magnet, a lid cover, and a second magnet. The wall and bottom panel collectively define a liquid-storage area. The lid is detachably engaged with the opening of the wall. The first magnet is rigidly coupled to the lid, such as via being embedded within the lid. The lid cover is engaged with the lid. The lid cover rotateably actuates between an open position and a closed position with respect to the lid. The second magnet is rigidly coupled to the lid cover. Magnetic engagement between the first magnet and the second magnet bias the lid cover from transitioning from the closed position to the open position.

In a specific embodiment, the beverage container includes a first piece of ferrous metal rigidly coupled to the lid. Magnetic engagement between the first piece of ferrous metal and the second magnet bias the lid cover from transitioning from the open position to the closed position. In a specific embodiment, the lid includes a plurality of ears that extend radially inward from a periphery of the lid. The ears interface with the lid cover to bias the lid cover towards the bottom panel. In a specific embodiment, the lid cover includes a chamfered edge that interfaces with the ears.

Another embodiment of the invention relates to a beverage container cover assembly configured to couple to an opening of a beverage container. The beverage container cover assembly includes a lid, a first magnet, a lid cover, and a second magnet. The lid is configured to detachably engaged with the beverage container. The first magnet is rigidly coupled to the lid, such as via being embedded within the lid. The lid cover is engaged with the lid. The lid cover rotatably actuates between an open position and a closed position with respect to the lid. The second magnet is rigidly coupled to the lid cover. Magnetic engagement between the first magnet and the second magnet bias the lid cover from transitioning from the closed position to the open position.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a lid and lid cover for a beverage container are shown. The lid and lid cover are designed to selectively actuate between an open position and a closed position. In the open position, the beverage is accessible, for example for a user to drink. In the closed position, the beverage is mostly or fully enclosed within the beverage container, thereby protecting the beverage from spilling out of the container.

Various embodiments of the lids and lid covers described herein include combinations of magnets and magnetically-responsive components. In various embodiments the lids and lid covers are biased to remain in the open position, in the closed position, or in both the open and the closed positions. Various embodiments of lids include one or more protrusions that interface with the lid cover to bias the lid cover to remain stationary with respect to the lid. In various embodiments, the lids are configured to couple to a beverage container that couples to a cleat in a Milwaukee PACK-OUT™ modular storage unit.

Figure 1:
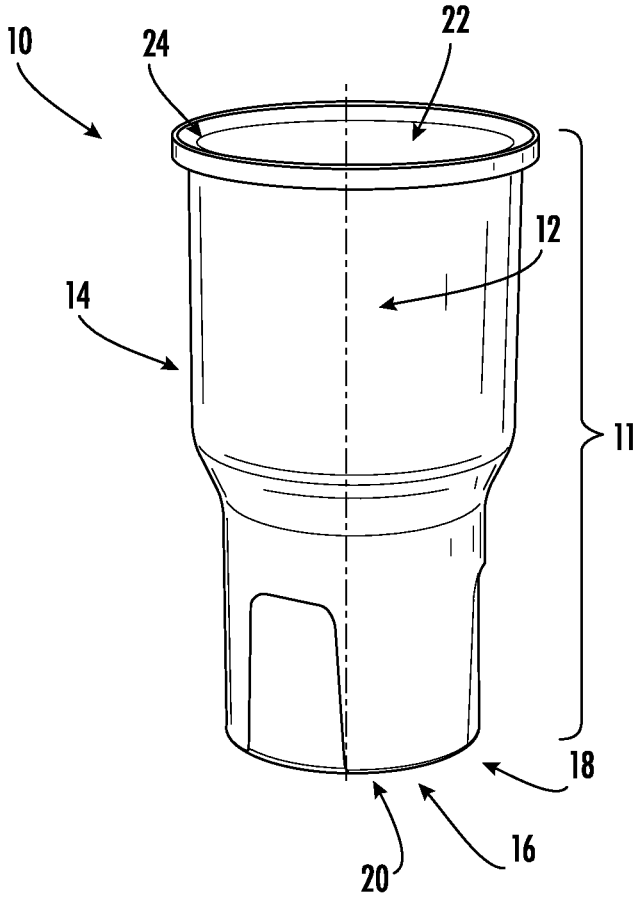
FIG. 1 is a perspective view of a beverage container, according to an exemplary embodiment.

Referring to FIG. 1, a drinking container, unit and/or device, such as beverage container 10, is shown according to an exemplary embodiment. In various embodiments, beverage container 10 includes bottom panel 18, a wall 14, such as a cylindrical wall, a lid 30, and a lid cover 60 coupled to lid 30. Stated another way, in various embodiments beverage container 10 includes body 11 includes bottom panel 18 and wall 14, and body 11 defines liquid-storage area 22 and upper opening 24. Lid 30 is coupled to the wall 14 and/or body 11 (e.g., via wall 14). Each of the lid 30 and lid cover 60 include one or more magnetically-responsive elements (e.g., magnets and/or ferrous metals). Bottom panel 18 of container 10 defines a bottom-most surface 20 of container 10. An enclosing element, shown as wall 14, extends upwardly from bottom panel 18. Bottom panel 18 and wall 14 collectively partially define a storage area, shown as liquid-storage area 22. In various embodiments one or more of body 11, wall 14, and bottom panel 18 are centered on axis 12.

Wall 14 extends upwardly from bottom panel 18. Wall 14 defines upper opening 24 opposite bottom panel 18. One or more of lids described herein are configured to couple to wall 14 at upper opening 24, thereby fully or mostly enclosing liquid-storage area 22. For example, lid 30 is coupled to wall 14 and partially covers the upper opening 24, and the lid 30 defines a drinking opening 32 smaller than the upper opening 24. In a specific embodiment, one or more of bottom panel 18, walls 14, and upper opening 24 are centered on axis 12.

In a specific embodiment, coupling component 16 extends along bottom panel 18. In a specific embodiment, coupling component 16 is compatible with the coupling mechanism (s) described in International Patent Publication No. WO 2017/191628, which is incorporated herein by reference in its entirety.

One or more lids described herein are configured to reversibly and detachably engage and disengage with wall 14, such as at upper opening 24 of wall 14. In various embodiment, the lids described herein engage with a beverage container via an interference fit.

Referring to FIGS. 2-5, an enclosing component, shown as beverage container cover assembly 28, is shown according to an exemplary embodiment. Beverage container coverage assembly 28 includes lid 30 and lid cover 60. Lid cover 60 is rotatably and slidably engaged to lid 30. Lid cover 60 rotatably actuates between an open position (FIG. 2) and a closed position (FIG. 3) with respect to the lid 30. In various embodiments, lid cover 60 includes upwardly-extending projection 74 that extends upward from the body 72 of lid cover 60, the upwardly-extending projection 74 being configured to interface with a user actuating the lid cover 60 between the open position and the closed position. When lid cover 60 is in the closed position, the lid cover 60 occludes the drinking opening 32 of lid 30, and when lid cover 60 is in the open position the drinking opening 32 of lid 30 provides fluid communication between the liquid-storage area 22 and an exterior of the drinking container 10. In various embodiments lid 30 and lid cover 60 are coupled to a top of a beverage container, thereby enclosing a beverage stored within the beverage container.

In the open position (FIG. 2), drinking opening 32 of lid 30 and drinking opening 62 of lid cover 60 are aligned, thereby permitting a user to remove liquid through the openings (e.g., by drinking the beverage). In the closed position (FIG. 3), drinking opening 32 of lid 30 and drinking opening 62 of lid cover 60 are rotated out of alignment, thereby enclosing the liquid-storage area 22 of the beverage container. In the closed position, the beverage is sealed within the liquid-storage area 22 of the beverage container, thereby reducing and/or minimizing the ability of the beverage to leak out of the liquid-storage area of the beverage container.

Lid 30 includes a curved recess, shown as arcuate-shaped recess 38, that extends circumferentially around a portion of lid 30 and/or axis 12 and is centered around axis 12. Lid cover 60 includes body 72, which extends circumferentially around axis 12, and projection 68, which extends radially inward from body 72 towards axis 12. Stated another way, projection 68 is inwardly-extending extending from body 72 towards the axis 12. Recess 38 receives inwardly-extending projection 68. As lid cover 60 actuates between the open and closed positions with respect to lid 30, projection 68 rotates within recess 38 of lid 30. In a specific embodiment, the bottom portion of lid cover 60 includes a recess 64 that extends radially away from axis 12.

A magnetically-responsive component, shown as magnet 70, is coupled to lid cover 60. In a specific embodiment, magnet 70 is rigidly coupled to lid cover 60, such as via magnet 70 being embedded within lid cover 60. As will be described, magnet 70 biases lid cover 60 to remain stationary with respect to lid 30. In various embodiments, magnet 70 includes a plurality of magnets (e.g., stacked magnets).

Figure 4:
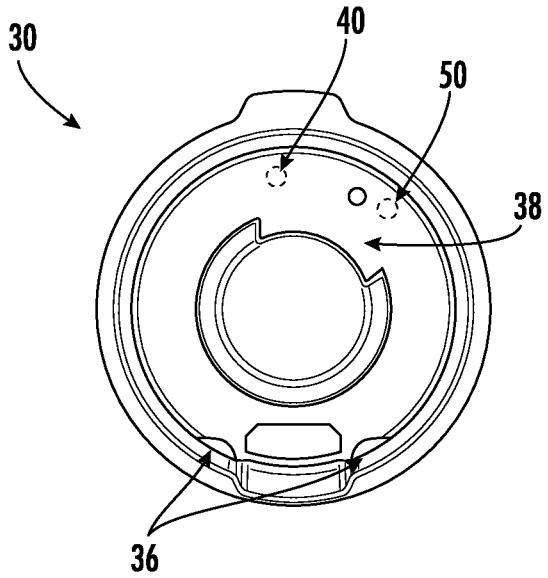
FIG. 4 is a top view of the lid of FIG. 2, according to an exemplary embodiment.
Figure 5:
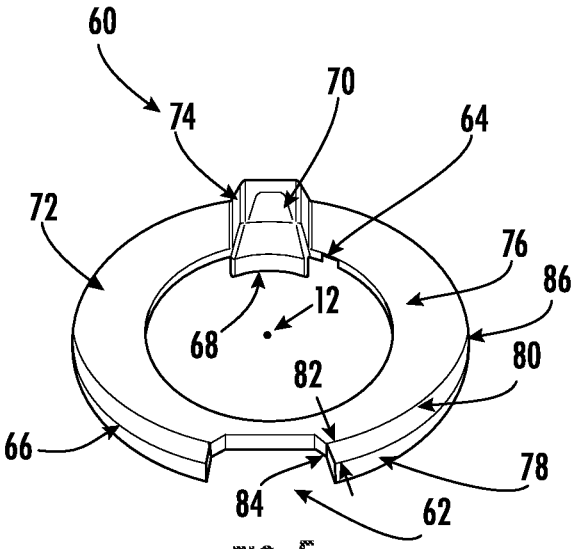
FIG. 5 is a perspective view of the lid cover of FIG. 2, according to an exemplary embodiment.

Referring to FIGS. 4-5, in various embodiments a first magnetically-responsive component, shown as ferrous metal 40, is coupled to lid 30, and a second magnetically-responsive component, shown as magnet 50, is coupled to lid 30. In a specific embodiment, ferrous metal 40 and/or magnet 50 are rigidly coupled to lid 30, such as via being embedded within lid 30. As lid cover 60 actuates with respect to the lid 30 between the open and closed positions, magnet 70 of lid cover 60 magnetically engages with either ferrous metal 40 (open position) or magnet 50 (closed position). In various embodiments, the ferrous metal comprises or consists of steel (e.g., ferrous metal 40 is formed from steel).

In the closed position (FIG. 2), magnet 70 of lid cover 60 is magnetically engaged with magnet 50. Because of this engagement, lid cover 60 is biased from transitioning from the closed position into the open position. Stated another way, magnetic engagement between a first magnetically-responsive element (e.g., magnet 50) coupled to lid 30 and a second magnetically-responsive element (e.g., magnet 70) coupled to lid cover 60 biases the lid cover 60 from transitioning from the closed position to the open position with respect to the lid 30. In various embodiments, container 10 includes one or more protrusions, shown as ears 36, that extend radially inward from annular wall 34 and/or lid 30 with respect to axis 12. In a specific embodiment, an upper edge, shown as chamfered corner edge 66, of lid cover 60 interfaces with ears 36 to bias lid cover 60 downward (e.g., towards a bottom panel of a beverage container).

In various embodiments, the interface between ears 36 and edge 66 biases lid cover 60 to remain stationary with respect to lid 30. Stated another way, frictional engagement between the ear(s) 36 and the lid cover 60 biases the lid cover 60 to remain stationary with respect to the lid 30. In various embodiments, lid cover 60 defines an upper surface 76 facing upward away from the bottom panel 18, a lateral surface 78 facing radially away from the axis 12, and an angled upper edge 80 extending between the lateral surface 78 and the upper surface 76. Angled upper edge 80 extends circumferentially away from the second drinking opening 62, and frictional engagement between the ear(s) 36 and the angled upper edge 80 biases the lid cover 60 to remain stationary with respect to the lid 30. Angled upper edge 80 defines a width 82 with respect to the axis 12, and the angled upper edge 80 is ramped such that the width 82 decreases as the angled upper edge 80 extends away from the second drinking opening 62. Stated another way, width 82 decreases as angled upper edge 80 extends from first end 84 to an opposing second end 86 of angled upper edge 80. The varying width 82 of angled upper edge 80 facilitates a tighter seal between lid 30 and wall 14 compared to lids that do not include an angled upper edge with a varying width.

Angled upper edge 80 extends circumferentially angle 88 degrees between first end 84 and second end 86 with respect to axis 12. In various embodiments, angle 88 is between 25 degrees and 110 degrees, and more specifically is between 40 degrees and 85 degrees, and more specifically is between 55 degrees and 65 degrees, and more specifically is 58 degrees.

Lid cover 60 rotates relative to (e.g., with respect to) lid 30 an angle 90 with respect to axis 12. In various embodiments, angle 90 is between 25 degrees and 100 degrees, and more specifically is between 35 degrees and 75 degrees, and more specifically is between 45 degrees and 58 degrees, and more specifically is 50 degrees.

In the open position (FIG. 3), magnet 70 of lid cover 60 is magnetically engaged with ferrous metal 40. Because of this engagement, lid cover 60 is biased from transitioning from the open position into the closed position. Stated another way, magnetic engagement between a third magnetically-responsive element (e.g., ferrous metal 40, such as steel) coupled to lid 30 and second magnetically-responsive element (e.g., magnet 70) coupled to lid cover 60 biases the lid cover 60 from transitioning from the open position to the closed position with respect to the lid 30. In a specific embodiment, ears 36 bias lid cover 60 from being removed from lid 30 when lid cover 60 is in the closed position.

In various embodiments, a first magnetically-responsive element (e.g., ferrous metal 40, such as steel) is coupled to lid 30, a second magnetically-responsive element (e.g., magnet 70) is coupled to lid cover 60, and a third magnetically-responsive element is coupled to one of lid 30 and lid cover 60. The third magnetically-responsive element interfaces with one of the magnetically-responsive elements coupled to either the lid 30 or the lid cover 60. In a specific embodiment, the third magnetically-responsive element is coupled to lid 30 (e.g., magnet 50), and magnetically interfaces with magnet 70 coupled to lid cover 60.

Figure 6:
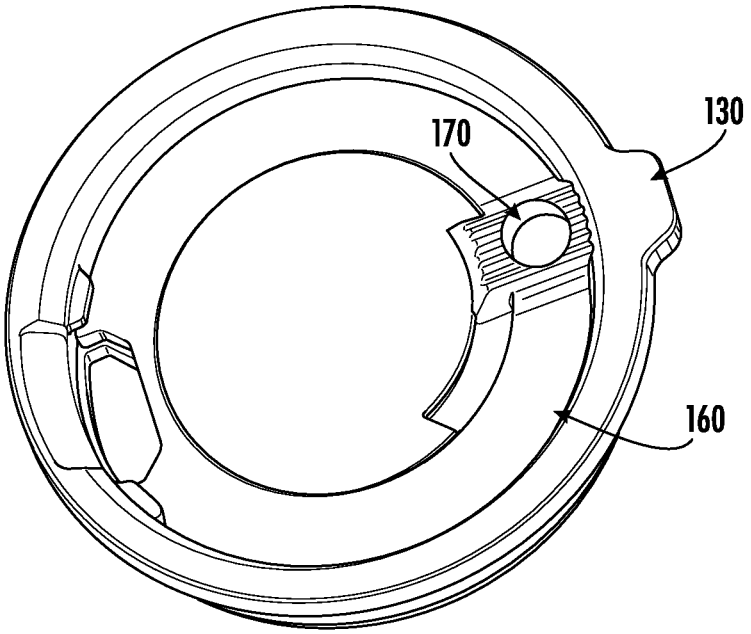
FIG. 6 is a perspective view from above of a lid and lid cover, according to an exemplary embodiment.
Figure 7:
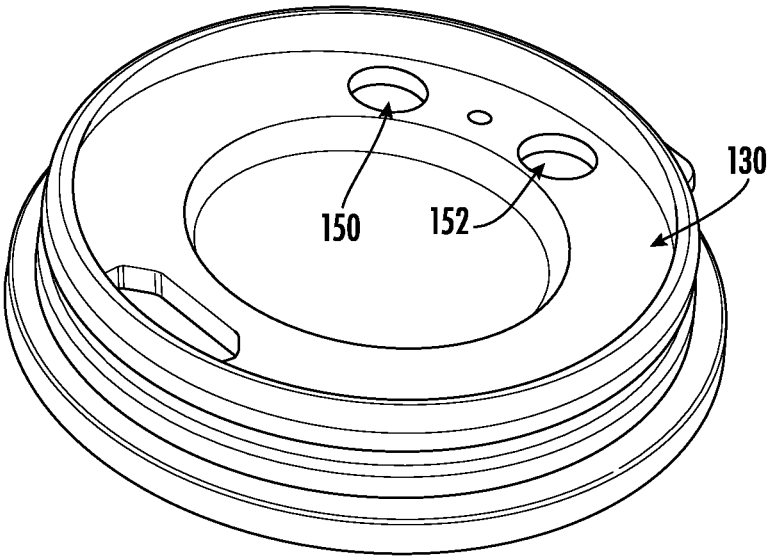
FIG. 7 is a perspective view from below of the lid of FIG. 6, according to an exemplary embodiment.

Referring to FIGS. 6-7, lid 130 and lid cover 160 are shown according to exemplary embodiments. Lid 130 is substantially the same as lid 30 except for the differences discussed herein, and lid cover 160 is substantially the same as lid cover 60 except for the differences discussed herein.

Lid cover 160 includes a magnetically-responsive component, shown as magnet 170. As lid cover 160 actuates between the closed and open positions with respect to lid 130, magnet 170 engages with magnetically-responsive component, shown as magnet 150, or magnetically-responsive component, shown as magnet 152, respectively.

Figure 8:
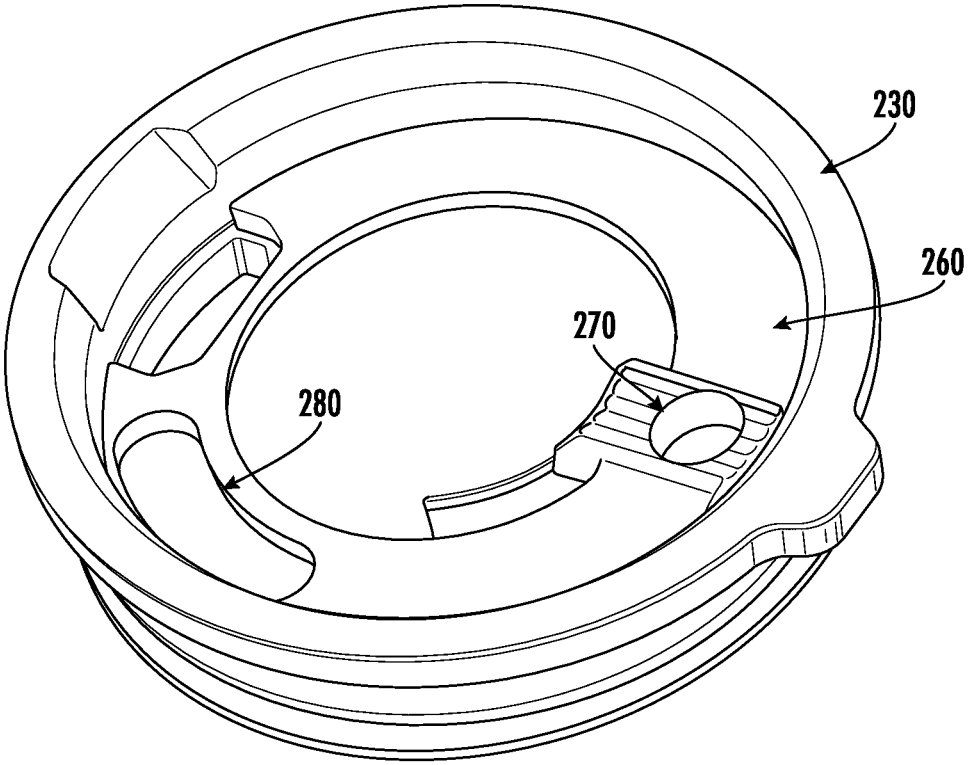
FIG. 8 is a perspective view from above of a lid and lid cover, according to an exemplary embodiment.
Figure 9:
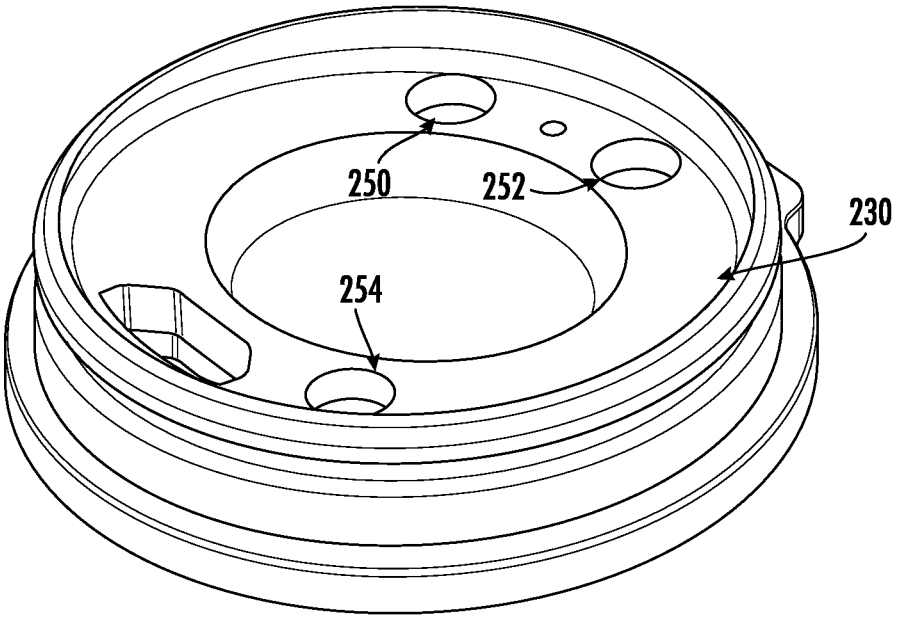
FIG. 9 is a perspective view from below of the lid of FIG. 8, according to an exemplary embodiment.

Referring to FIGS. 8-9, lid 230 and lid cover 260 are shown according to exemplary embodiments. Lid 230 is substantially the same as lid 30 or lid 130 except for the differences discussed herein, and lid cover 260 is substantially the same as lid cover 60 or lid cover 160 except for the differences discussed herein.

Lid cover 260 includes a first magnetically-responsive component, shown as magnet 270, and a second magnetically-responsive component, shown as ferrous metal 280. In a specific embodiment, ferrous metal 280 partially extends circumferentially around lid cover 260 with respect to the central axis, thereby defining a curved shape. Lid 230 includes three magnetically-responsive components, shown as magnets 250, 252, and 254.

When lid cover 260 is in the closed position, magnet 254 is engaged with ferrous metal 280 and magnet 270 is engaged with magnet 252. When lid cover is in the open position, magnet 270 is engaged with magnet 250.

Figure 10:
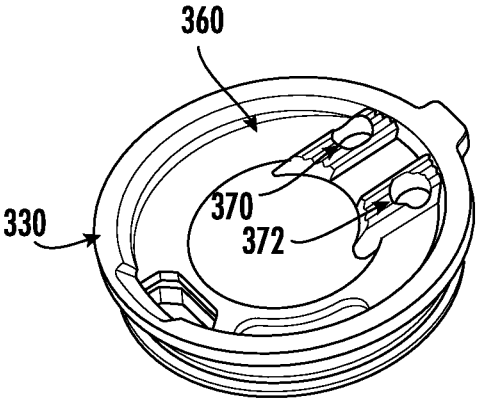
FIG. 10 is a perspective view from above of a lid and lid cover, according to an exemplary embodiment.
Figure 11:
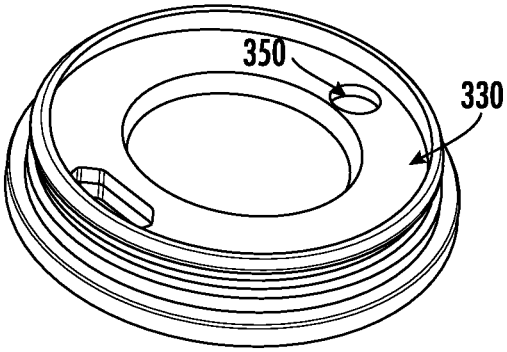
FIG. 11 is a perspective view from below of the lid of FIG. 10, according to an exemplary embodiment.

Referring to FIGS. 10-11, lid 330 and lid cover 360 are shown according to exemplary embodiments. Lid 330 is substantially the same as lid 30, lid 130, or lid 230 except for the differences discussed herein, and lid cover 360 is substantially the same as lid cover 60, lid cover 160, or lid cover 260 except for the differences discussed herein.

Lid cover 360 includes magnets 370, 372. Lid 330 includes magnet 350. Magnets 370, 372 selectively engage with magnet 350 as lid cover 360 actuates between the open and closed positions with respect to lid 330.

Figure 12:
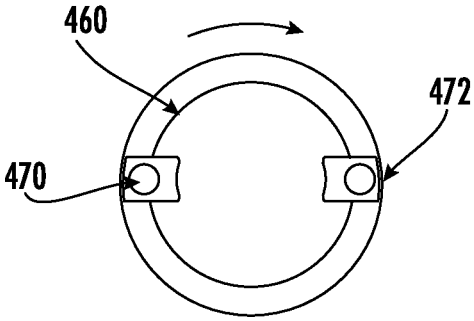
FIG. 12 is a schematic view of a lid cover, according to an exemplary embodiment.
Figure 13:
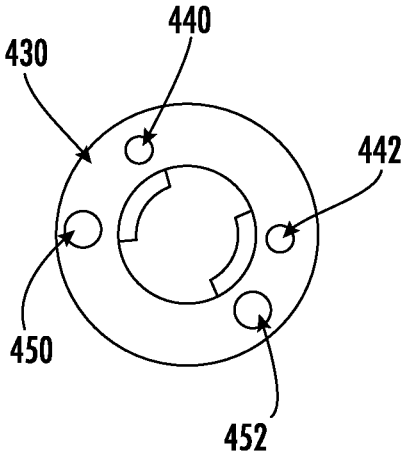
FIG. 13 is a schematic view of a lid, according to an exemplary embodiment.
Figure 14:
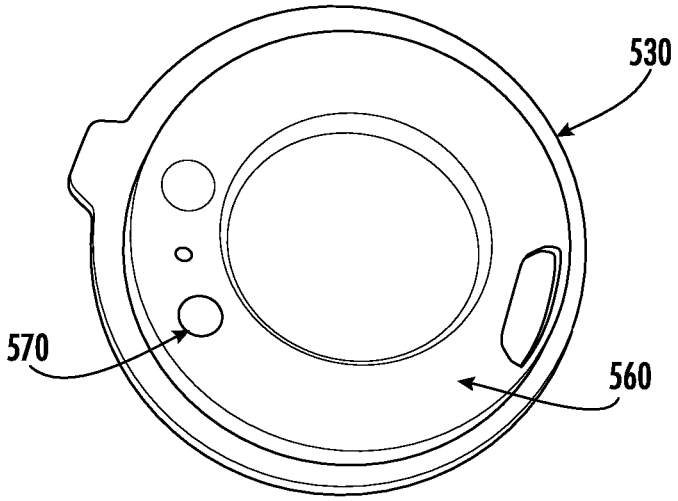
FIG. 14 is a bottom view of a beverage container cover assembly, according to an exemplary embodiment.
Figure 15:
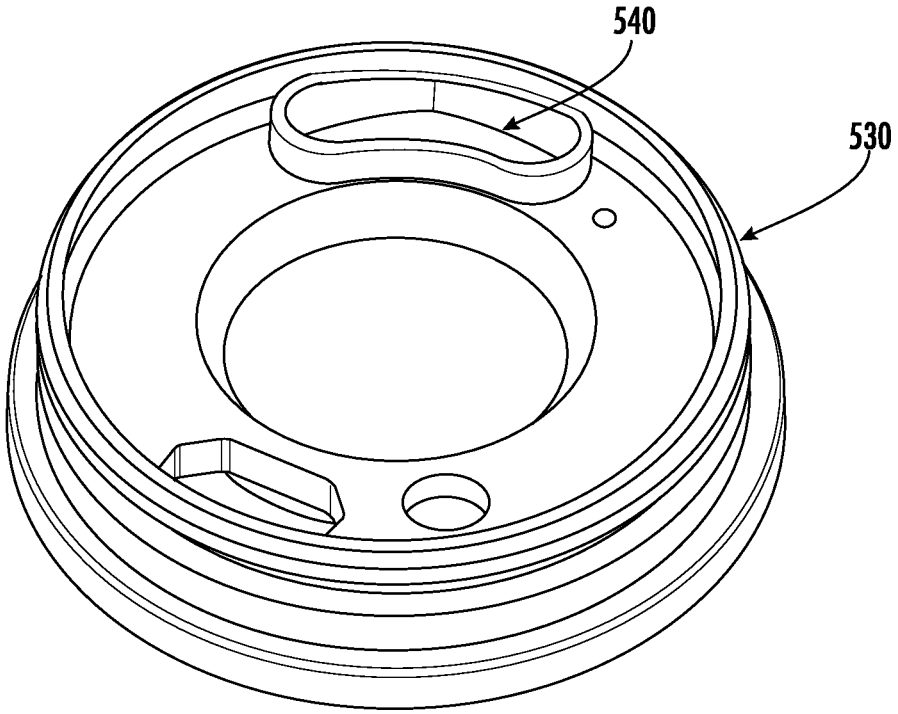
FIG. 15 is a perspective view of the beverage container cover assembly of FIG. 14, according to an exemplary embodiment.
Figure 16:
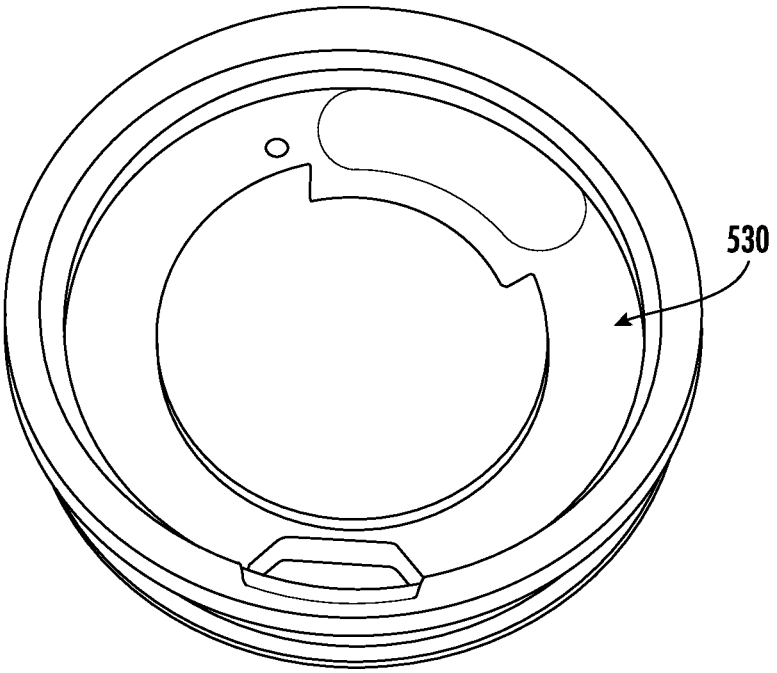
FIG. 16 is a perspective view of a portion of the beverage container cover assembly of FIG. 14, according to an exemplary embodiment.
Figure 17:
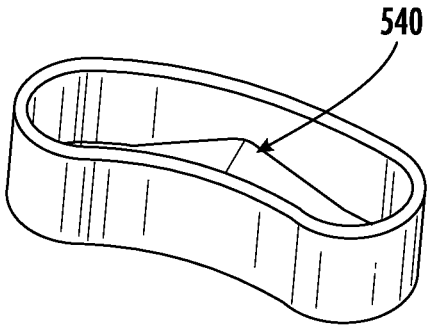
FIG. 17 is a perspective view of a portion of the beverage container cover assembly of FIG. 14, according to an exemplary embodiment.
Figure 18:
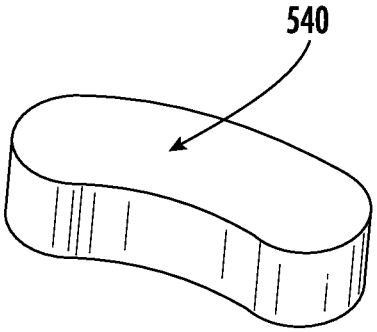
FIG. 18 is a perspective view of a portion of the beverage container cover assembly of FIG. 14, according to an exemplary embodiment.
Figure 19:
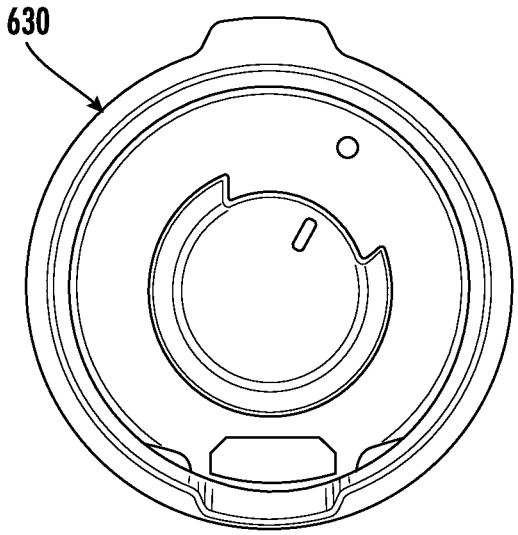
FIG. 19 is a top view of a lid, according to an exemplary embodiment.
Figure 20:
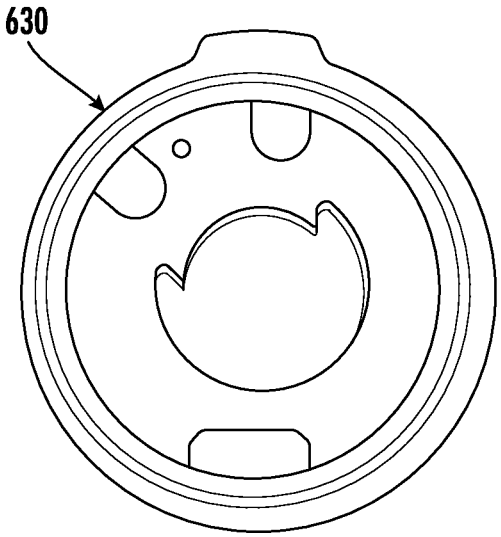
FIG. 20 is a bottom view of the lid of FIG. 19, according to an exemplary embodiment.
Figure 21:
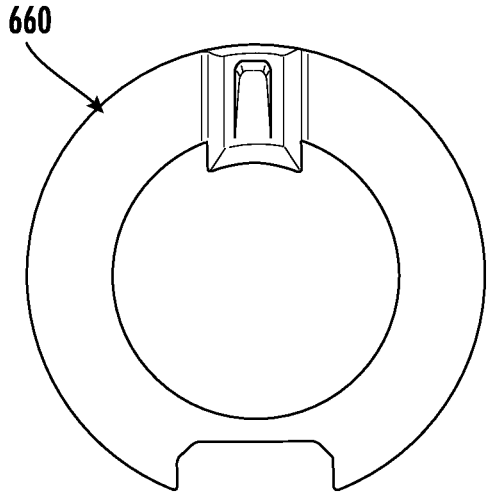
FIG. 21 is a top view of a lid cover, according to an exemplary embodiment.
Figure 22:
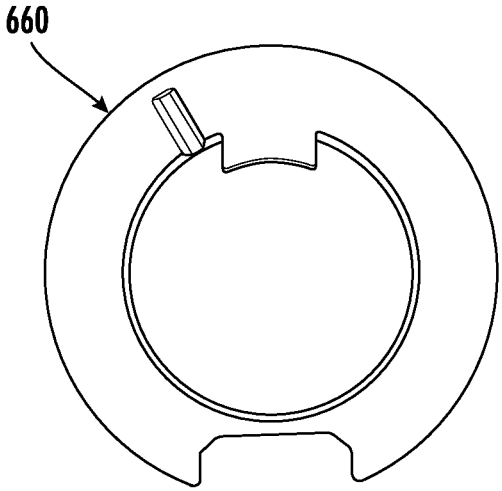
FIG. 22 is a bottom view of the lid cover of FIG. 21, according to an exemplary embodiment.
Figure 23:
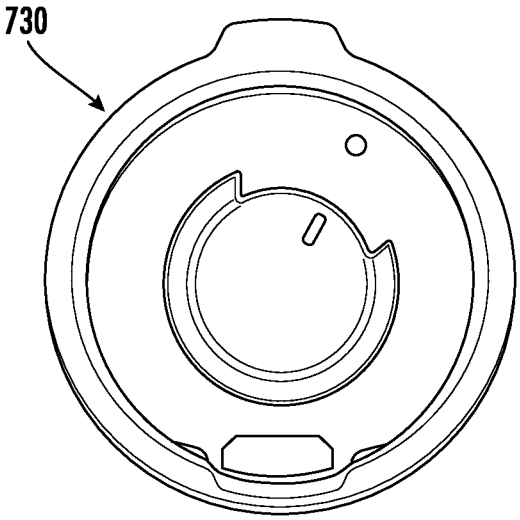
FIG. 23 is a top view of a lid, according to an exemplary embodiment.
Figure 24:
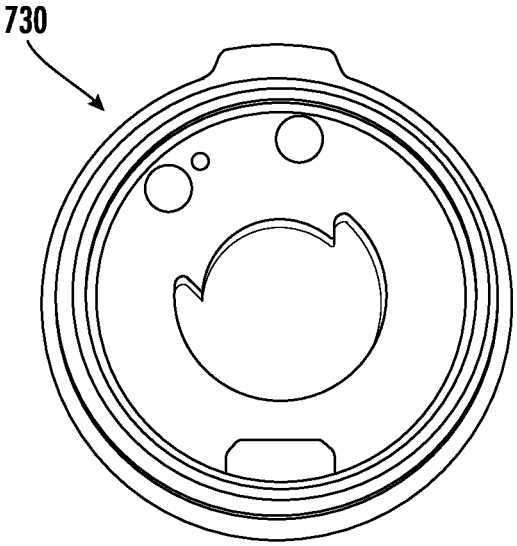
FIG. 24 is a bottom view of the lid of FIG. 23, according to an exemplary embodiment.
Figure 25:
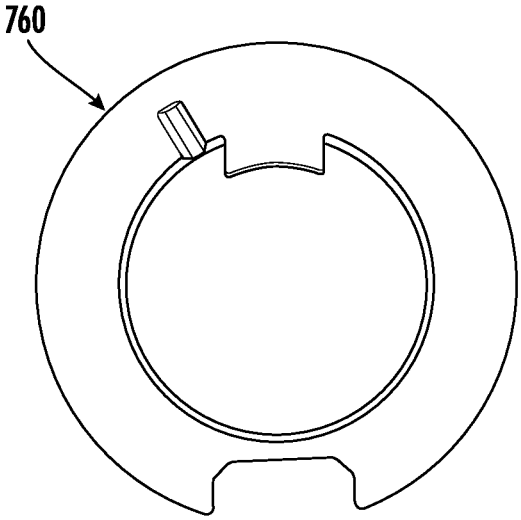
FIG. 25 is a top view of a lid cover, according to an exemplary embodiment.
Figure 26:
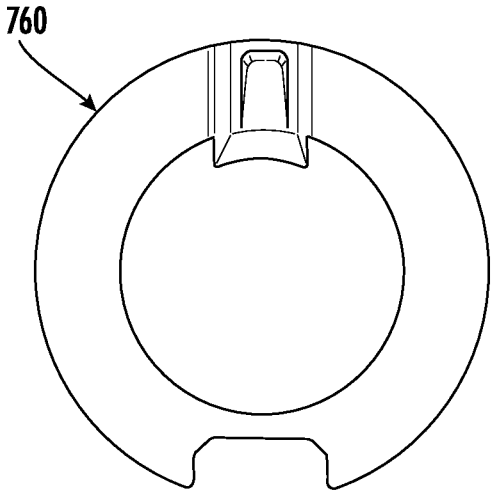
FIG. 26 is a bottom view of the lid cover of FIG. 25, according to an exemplary embodiment.
Figure 27:
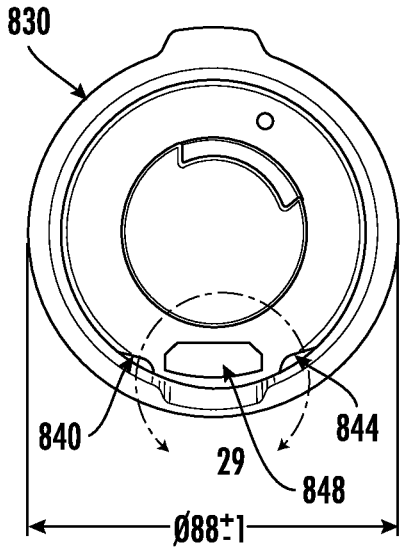
FIG. 27 is a schematic view of a lid, according to an exemplary embodiment.
Figure 28:
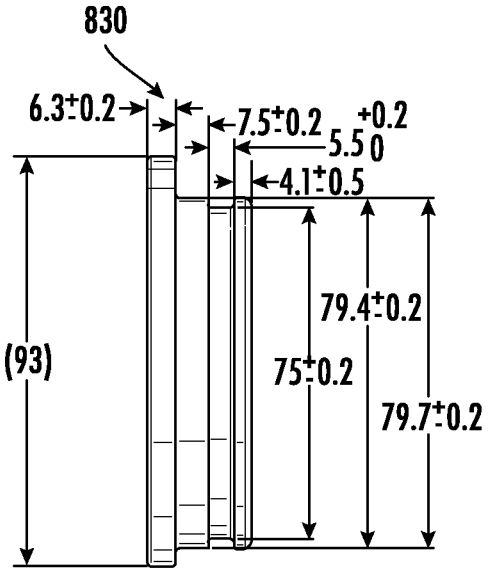
FIG. 28 is a schematic view of the lid of FIG. 27, according to an exemplary embodiment.
Figure 29:
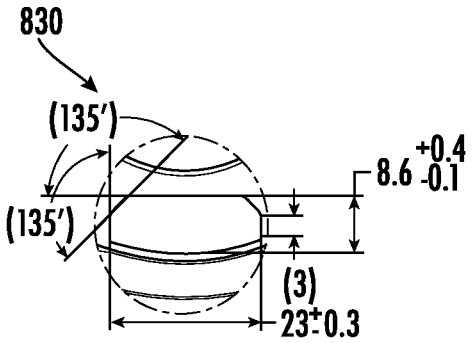
FIG. 29 is a schematic view of the lid of FIG. 27, according to an exemplary embodiment.

Referring to FIGS. 12-13, lid 430 and lid cover 460 are shown according to exemplary embodiments. Lid 430 is substantially the same as lid 30, lid 130, lid 230, or lid 330 except for the differences discussed herein, and lid cover 460 is substantially the same as lid cover 60, lid cover 160, lid cover 260, or lid cover 360 except for the differences discussed herein.

Lid cover 460 includes magnet 470, 472. Lid 430 includes ferrous metal 440, 442 and magnets 450, 452. When lid cover 460 is in the open position, magnet 470 engages with magnet 450 and magnet 472 engages with ferrous metal 442. When lid cover 460 is in the closed position, magnet 470 engages with ferrous metal 440 and magnet 472 engages with magnet 452.

Referring to FIGS. 14-18, a beverage container cover assembly including lid 530 and lid cover 560 is shown according to exemplary embodiments. Lid 530 is substantially the same as lid 30, lid 130, lid 230, lid 330, or lid 430 except for the differences discussed herein, and lid cover 560 is substantially the same as lid cover 60, lid cover 160, lid cover 260, lid cover 360, or lid cover 460 except for the differences discussed herein.

Lid cover 560 includes a magnet 570. Lid 530 includes a magnet that moves within magnetic structure 540 as lid cover 560 rotates with respect to lid 530 because the magnet within magnetic structure 540 is attracted to magnet 570, which is fixedly coupled to lid cover 560.

Referring to FIGS. 19-22, lid 630 and lid cover 660 are shown according to exemplary embodiments. Lid 630 is substantially the same as lid 30, lid 130, lid 230, lid 330, lid 430, or lid 530 except for the differences discussed herein, and lid cover 560 is substantially the same as lid cover 60, lid cover 160, lid cover 260, lid cover 360, lid cover 460, or lid cover 560 except for the differences discussed herein.

Referring to FIGS. 23-26, lid 730 and lid cover 760 are shown according to exemplary embodiments. Lid 730 is substantially the same as lid 30, lid 130, lid 230, lid 330, lid 430, lid 530, or lid 630 except for the differences discussed herein, and lid cover 760 is substantially the same as lid cover 60, lid cover 160, lid cover 260, lid cover 360, lid cover 460, lid cover 560, or lid cover 660 except for the differences discussed herein.

Referring to FIGS. 27-42, lid 830 and lid cover 860 are shown according to exemplary embodiments. Unless otherwise stated, the depicted measurements are metric (e.g., millimeters). Lid 830 is substantially the same as lid 30, lid 130, lid 230, lid 330, lid 430, lid 530, lid 630, or lid 730 except for the differences discussed herein, and lid cover 860 is substantially the same as lid cover 60, lid cover 160, lid cover 260, lid cover 360, lid cover 460, lid cover 560, lid cover 660, or lid cover 760 except for the differences discussed herein.

Various exemplary dimensions of lid 830 and lid cover 860 are shown. In particular, lid 830 includes central portion 832, outer portion 834, and upper surface 836 of outer portion 834. In various embodiments, outer portion 834 peripherally surrounds central portion 832 and upper surface 836 of outer portion 834 is lower than upper surface of central portion 832. Stated another way, upper surface 836 of outer portion 834 is closer to the bottom of the container that lid 830 is affixed to than upper surface of central portion 832.

First ear 840 and second ear 844 extend radially inward from an outer wall of lid 830 towards a center of lid 830. Lid cover 860 is positioned between upper surface 836 of outer portion 834 and first ear 840 and second ear 844. As a result first ear 840 and second ear 844 bias lid cover 860 to remain coupled to lid 830 (e.g., by first ear 840 and/or second ear 844 biasing lid cover 860 downward). In various embodiments, first ear 840 and second ear 844 are located on opposing peripheral sides of opening 848 of lid 830.

Figure 33:
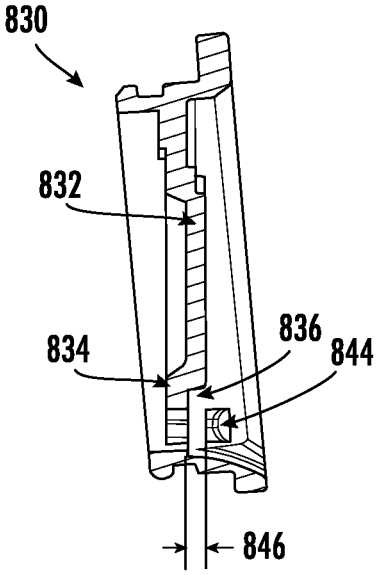
FIG. 33 is a schematic view of the lid of FIG. 27, according to an exemplary embodiment.
Figure 34:
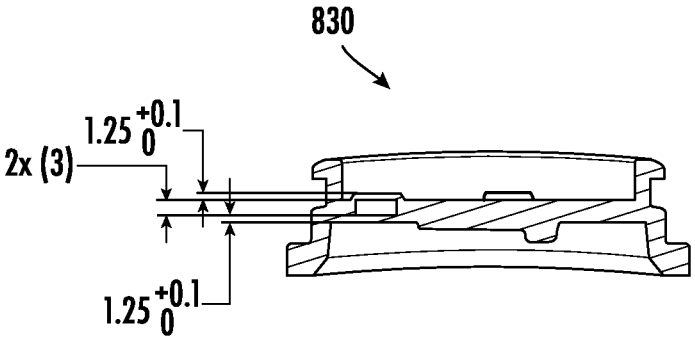
FIG. 34 is a schematic view of the lid of FIG. 27, according to an exemplary embodiment.
Figure 35:
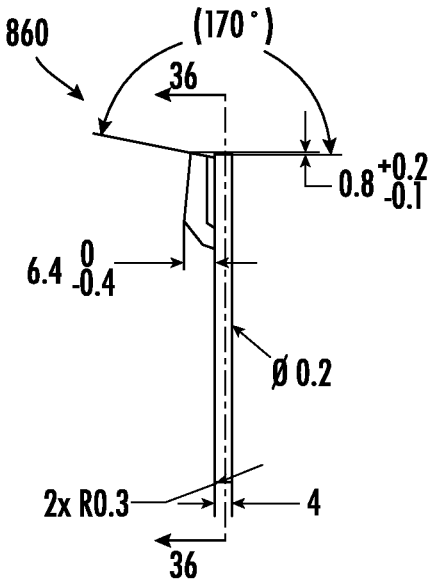
FIG. 35 is a schematic view of a lid cover, according to an exemplary embodiment.
Figure 36:
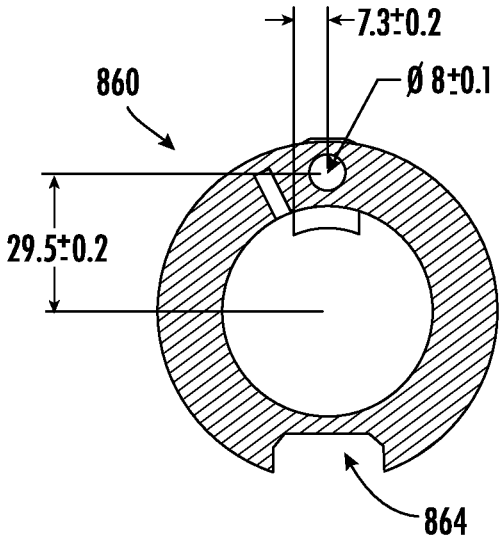
FIG. 36 is a schematic view of the lid cover of FIG. 35, according to an exemplary embodiment.
Figure 37:
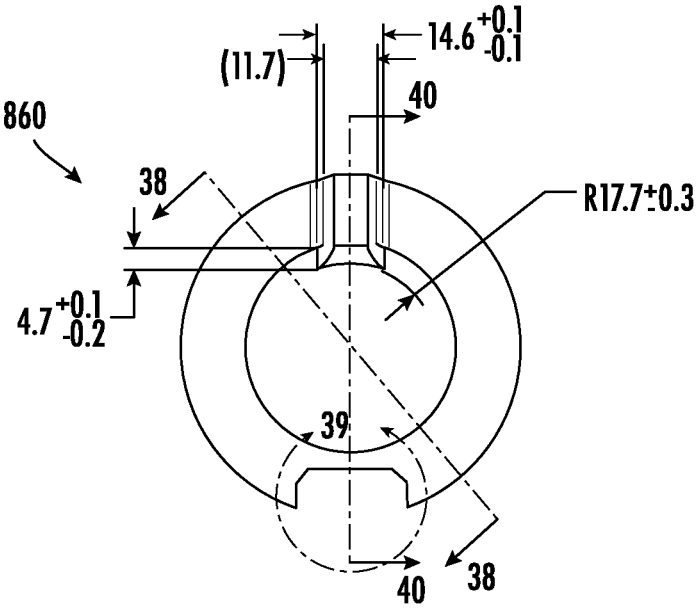
FIG. 37 is a schematic view of the lid cover of FIG. 35, according to an exemplary embodiment.
Figure 38:
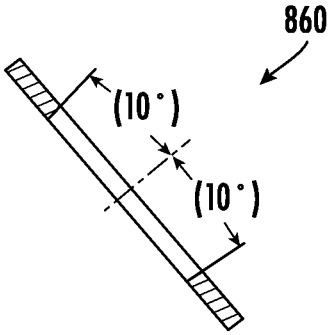
FIG. 38 is a schematic view of the lid cover of FIG. 35, according to an exemplary embodiment.
Figure 39:
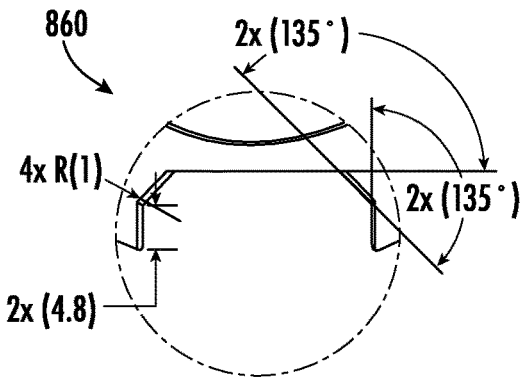
FIG. 39 is a schematic view of the lid cover of FIG. 35, according to an exemplary embodiment.
Figure 40:
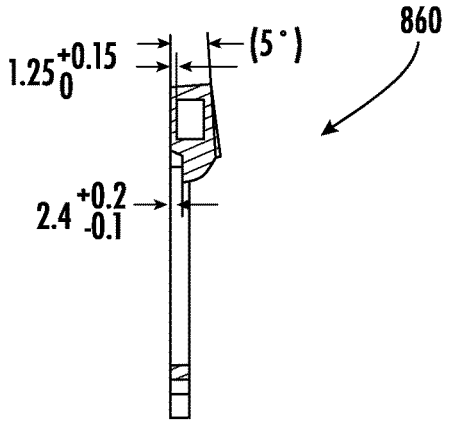
FIG. 40 is a schematic view of the lid cover of FIG. 35, according to an exemplary embodiment.
Figure 41:
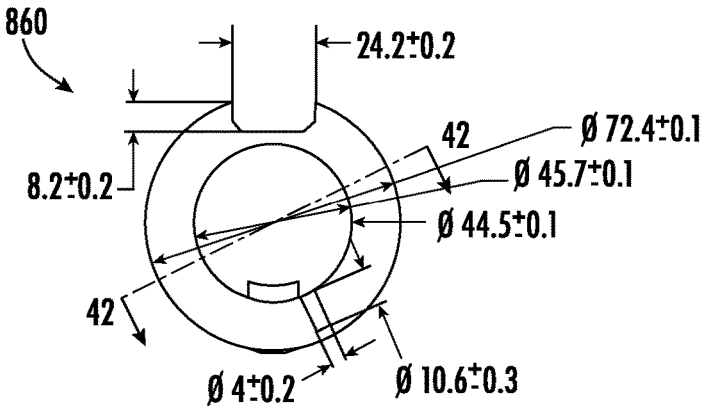
FIG. 41 is a schematic view of the lid cover of FIG. 35, according to an exemplary embodiment.
Figure 42:
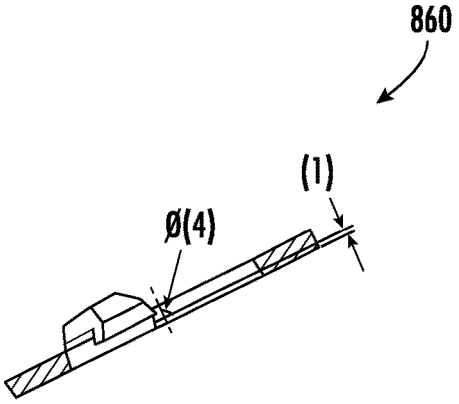
FIG. 42 is a schematic view of the lid cover of FIG. 35, according to an exemplary embodiment.

First ear 840 is distance 842 above upper surface 836 of outer portion 834 (FIG. 31), and second ear 844 is distance 846 above upper surface 836 of outer portion 834 (FIG. 33). In various embodiments, distance 842 is 3.89 mm, plus or minus 0.05 mm, and distance 846 is 4.09 mm, plus or minus 0.05 mm, and thickness of lid cover 860 is 4 mm. In various embodiments, the ratio of distance 846 to distance 842 is between 1:1.1 and 1:0.85, and more specifically between 1:1 and 1:0.90 and more specifically between 1:0.98 and 1:0.92, and even more specifically is 1:0.95.

Figure 2:
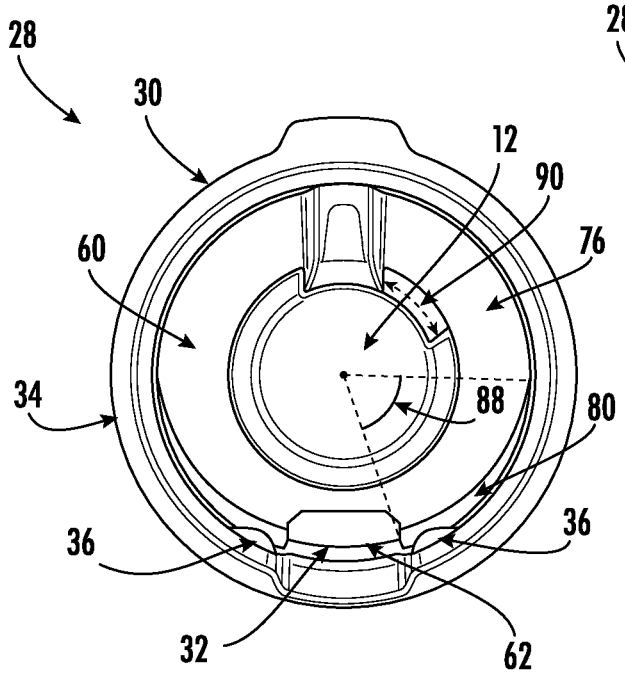
FIG. 2 is a top view of a lid assembly for a beverage container in an open position, according to an exemplary embodiment.
Figure 3:
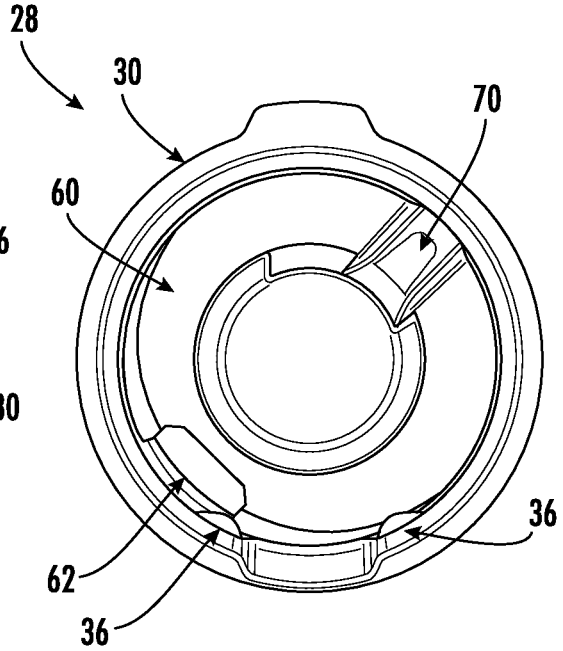
FIG. 3 is a top view of the lid assembly of FIG. 2 in a closed position, according to an exemplary embodiment.
Figure 30:
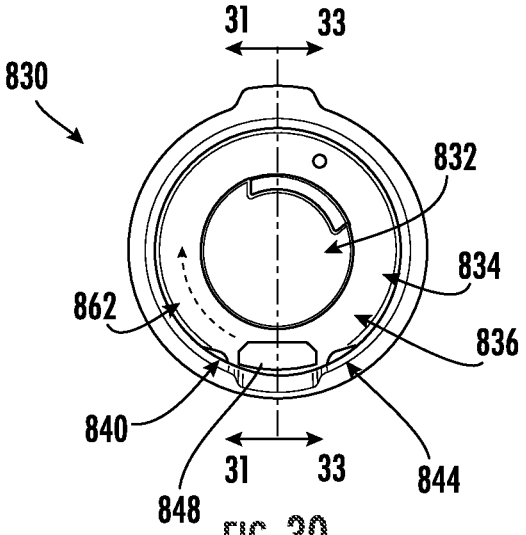
FIG. 30 is a schematic view of the lid of FIG. 27, according to an exemplary embodiment.
Figure 31:
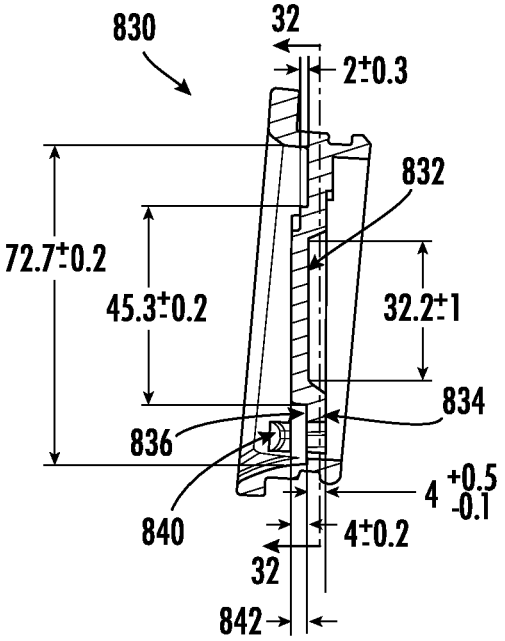
FIG. 31 is a schematic view of the lid of FIG. 27, according to an exemplary embodiment.
Figure 32:
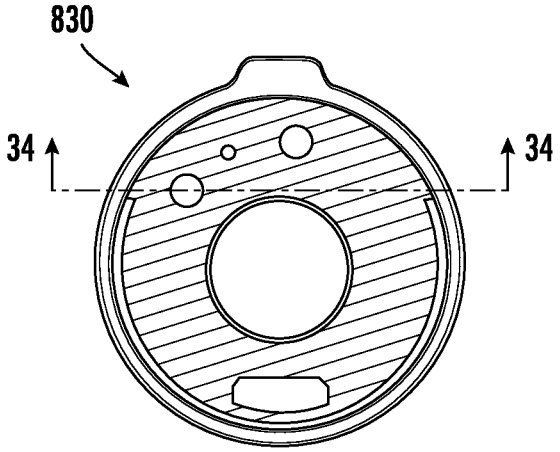
FIG. 32 is a schematic view of the lid of FIG. 27, according to an exemplary embodiment.

Referring to FIG. 30, lid cover 860 rotates in direction 862 relative to lid 830 when lid cover 860 actuates from the open position to the closed position. This rotation is similar to lid 30 and lid cover 60 (e.g., FIG. 2 showing the open position for lid cover 60 relative to lid 30 and FIG. 3 showing the closed position for lid cover 60 relative to lid 30). Thus, when lid cover 860 is in the closed position (e.g., opening 864 of lid cover 860 is not aligned with opening 848 of lid 830), first ear 840 biases lid cover 860 towards lid 830, thereby helping partially or entirely sealing liquid from transiting opening 848 of lid 830 and opening 864 of lid cover 860. In particular, since first ear 840 is closer to upper surface 836 than second ear 844 (see paragraph above), when lid cover 860 is in the closed position the shorter distance 842 for first ear 840 provides a tighter seal between lid cover 860 and lid 830 compared to if first ear 840 was distance 846 from upper surface 836. Further, the relative longer distance of second ear 844 compared to first ear 840 reduces the frictional resistance when lid cover 860 is rotating relative to lid 830.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A drinking container comprising:

a bottom panel that comprises a bottom-most surface, wherein the bottom panel is centered around an axis;

a wall that extends upwardly from the bottom panel, the wall and bottom panel collectively defining a liquid-storage area, the wall defining an upper opening opposite the bottom panel;

a lid coupled to the wall and partially covering the upper opening, the lid defining a first drinking opening smaller than the upper opening;

a first magnetically-responsive element coupled to the lid;

a lid cover rotatably coupled to the lid, the lid cover actuating between an open position and a closed position with respect to the lid, wherein when the lid cover is in the closed position the lid cover occludes the drinking opening, and when the lid cover is in the open position the drinking opening provides fluid communication between the liquid-storage area and an exterior of the drinking container;

a second magnetically-responsive element coupled to the lid cover, wherein magnetic engagement between the first magnetically-responsive element and the second magnetically-responsive element biases the lid cover from transitioning from the closed position to the open position; and a second projection extending inwardly from the lid towards the axis, wherein frictional engagement between the second projection and the lid cover biases the lid cover to remain stationary with respect to the lid;

wherein the lid cover defines:

a second drinking opening aligned with the first drinking opening when the lid cover is in the open position;

an upper surface facing upward away from the bottom panel;

a lateral surface facing radially away from the axis; and an angled upper edge extending between the lateral surface and the upper surface, wherein the angled upper edge extends circumferentially away from the second drinking opening, wherein frictional engagement between the second projection and the angled upper edge biases the lid cover to remain stationary with respect to the lid.

2. The drinking container of claim 1, wherein the second magnetically-responsive element comprises a first magnet.

3. The drinking container of claim 2, wherein the first magnetically-responsive element comprises a second magnet.

4. The drinking container of claim 1, wherein the second magnetically-responsive element comprises a plurality of magnets.

5. The drinking container of claim 1, comprising a third magnetically-responsive element coupled to one of the lid cover or the lid, wherein magnetic engagement between the third magnetically-responsive element and one of the first magnetically-responsive element and the second magnetically-responsive element biases the lid cover from transitioning from the open position to the closed position.

6. The drinking container of claim 5, wherein the third magnetically-responsive element is coupled to the lid.

7. The drinking container of claim 1, wherein the lid cover comprises a body that extends circumferentially around the axis, and an inwardly-extending projection that extends from the body towards the axis, wherein the lid comprises a recess that receives the inwardly-extending projection.

8. The drinking container of claim 7, wherein the recess extends circumferentially around the axis.

9. The drinking container of claim 7, the lid cover comprising an upwardly-extending projection that extends upward from the body, the upwardly-extending projection configured to interface with a user actuating the lid cover between the open position and the closed position.

10. The drinking container of claim 1, the angled upper edge defining a width with respect to the axis, wherein the angled upper edge is ramped such that the width decreases as the angled upper edge extends away from the second drinking opening.

11. The drinking container of claim 1, wherein the angled upper edge extends circumferentially around the lid cover between 25 and 110 degrees with respect to the axis.

12. The drinking container of claim 11, wherein the lid cover rotates between 25 and 100 degrees with respect to the lid.

13. A drinking container comprising:

a body defining a liquid-storage area and an upper opening, wherein the body comprises a bottom panel opposite the upper opening and the bottom panel is centered around an axis;

a lid coupled to the body and partially covering the upper opening, the lid defining a first drinking opening smaller than the upper opening;

a first magnetically-responsive element coupled to the lid;

a lid cover rotatably coupled to the lid, the lid cover actuating between an open position and a closed position with respect to the lid, wherein when the lid cover is in the closed position the lid cover occludes the drinking opening, and when the lid cover is in the open position the drinking opening provides fluid communication between the liquid-storage area and an exterior of the drinking container;

a second magnetically-responsive element coupled to the lid cover, wherein magnetic engagement between the first magnetically-responsive element and the second magnetically-responsive element biases the lid cover from transitioning from the open position to the closed position; and a projection extending inwardly from the lid towards the axis, wherein frictional engagement between the projection and the lid cover biases the lid cover to remain stationary with respect to the lid;

wherein the lid cover defines:

a second drinking opening aligned with the first drinking opening when the lid cover is in the open position;

an upper surface facing upward away from the bottom panel;

a lateral surface facing radially away from the axis; and an angled upper edge extending between the lateral surface and the upper surface, wherein the angled upper edge extends circumferentially away from the second drinking opening, wherein frictional engagement between the second projection and the angled upper edge biases the lid cover to remain stationary with respect to the lid.

14. The drinking container of claim 13, wherein the first magnetically-responsive element comprises a ferrous metal.

15. The drinking container of claim 14, wherein the second magnetically-responsive element comprises a first magnet.

16. The drinking container of claim 13, wherein the body is centered around an axis.

* * * * *